US005348193A

United States Patent [19]

Bruckner et al.

[11] Patent Number: 5,348,193

[45] Date of Patent: Sep. 20, 1994

[54] HOLDER FOR AEROSOL CAN

[75] Inventors: James V. Bruckner, Conway; Tony A. Bruckner, Clinton, both of Ark.

[73] Assignee: Mace Security International, Inc., Bennington, Vt.

[21] Appl. No.: 69,551

[22] Filed: May 28, 1993

[51] Int. Cl.[5] ..... B67D 5/64

[52] U.S. Cl. ..... 222/175; 220/625; 222/182; 222/183; 222/402.1; 222/635

[58] Field of Search ..... 222/175, 182, 183, 402.1, 222/402.13, 635; 220/345, 625

[56] References Cited

U.S. PATENT DOCUMENTS

| | | | |
|---|---|---|---|
| 2,914,222 | 11/1959 | Meshberg | 222/162 |
| 3,101,160 | 8/1963 | Picot | 222/183 |
| 3,128,916 | 4/1964 | Picot | 222/183 |
| 3,157,317 | 11/1964 | Ramsbotham | 222/183 |
| 3,344,959 | 10/1967 | Faso | 222/183 |
| 3,432,077 | 3/1969 | Voll | 222/78 |
| 3,450,313 | 6/1969 | Jonas | 222/175 X |
| 3,540,628 | 11/1970 | Trosch | 222/183 |
| 3,630,344 | 12/1971 | Bergh et al. | 220/345 X |
| 3,698,604 | 10/1972 | Nigro | 222/402.13 X |
| 3,712,515 | 1/1973 | Corll | 222/402.13 X |
| 3,830,404 | 8/1974 | Frazer | 222/78 |
| 3,934,761 | 1/1976 | Gentreau | 222/183 |
| 4,402,430 | 9/1983 | Fox et al. | 222/183 |
| 4,511,062 | 4/1985 | Wilkerson | 222/47 |
| 5,088,624 | 2/1992 | Hackett et al. | 222/78 |
| 5,249,677 | 10/1993 | Lim | 220/345 X |

FOREIGN PATENT DOCUMENTS

| | | | |
|---|---|---|---|
| 755467 | 5/1967 | Canada | 222/182 |
| 528697 | 6/1931 | Fed. Rep. of Germany | 220/345 |
| 3118752 | 12/1982 | Fed. Rep. of Germany | 220/345 |
| 272310 | 3/1930 | Italy | 220/345 |
| 488806 | 7/1938 | United Kingdom | 220/345 |

*Primary Examiner*—Andres Kashnikow
*Assistant Examiner*—Joseph A. Kaufman
*Attorney, Agent, or Firm*—Heslin & Rothenberg

[57] ABSTRACT

An aerosol dispenser comprises a body having an interior for holding an aerosol can. The body has a bottom portion with an opening therein that permits the insertion of the can into the interior in a first direction. A fastening end piece located on the bottom portion of the body holds the aerosol can within the interior and engages the body in a direction substantially orthogonal to the first direction of can insertion. In addition, the aerosol can may be inserted in a direction substantially parallel with the major axis of the body, the fastening end piece may have a lug which protrudes into the interior of the body when the fastening end piece has engaged the body, and the fastening end piece may engage the body by sliding into place. In one particular aspect, the aerosol dispenser is used for discharging a chemical repellant, such as tear gas.

14 Claims, 1 Drawing Sheet

HOLDER FOR AEROSOL CAN

FIELD OF THE INVENTION

The present invention relates generally to aerosol dispensers and, more particularly, to chemical repellant aerosol dispensers used for personal defense.

DESCRIPTION OF THE PRIOR ART

There is a variety of aerosol dispensers used in many applications including perfume dispensing, air freshening, and personal hygiene. One specific application for an aerosol dispenser is as a personal defense device that, for example, directs a chemical repellant spray towards a potential human or animal threat.

Typically, in a personal defense device, an aerosol can serves as the source of the chemical repellant. There are several known ways of inserting the aerosol can into the primary body of the device. One known form of personal defense device is cylindrical in shape and opens along a seam running lengthwise on the body to permit the insertion of the can into the interior of the body. This device is usually made of plastic and has a metal reinforcement along the seam of the body in the form of, for example, a metal rod. This is disadvantageous because it increases the cost and complexity of the device. Also, a device that opens along a seam in this manner often fails to hold an aerosol can tightly because of the increased clearances required for the hinge action and latching mechanism of such a device.

Thus, there is a need for an improved aerosol dispenser and, more specifically, an improved personal defense device that both holds the aerosol can more tightly, and reduces the cost and complexity of the device.

SUMMARY OF THE INVENTION

This need is satisfied, the limitations of the prior art overcome, and other benefits realized in accordance with the principles of the present invention by an aerosol dispenser comprising a body having an interior for holding an aerosol can. The body has a bottom portion with an opening therein that permits the insertion of the can into the interior in a first direction. A fastening means located on the bottom portion of the body holds the aerosol can within the interior and engages the body in a direction substantially orthogonal to the first direction of can insertion. In addition, the aerosol can may be inserted in a direction substantially parallel with the major axis of the body, the fastening means may have a lug which protrudes into the interior of the body when the fastening means has engaged the body, and the fastening means may engage the body by sliding into place.

In one particular aspect, the aerosol dispenser is used for discharging a chemical repellant, such as tear gas, and comprises a substantially cylindrical body having a major axis, an interior sized to accept the aerosol can, a discharge portion, and a bottom portion disposed distal from the discharge portion. The body has an opening proximate to the bottom portion for axial insertion of the aerosol can in a first direction into the interior. The aerosol dispenser further comprises a pair of engagement lugs, disposed on the bottom portion of and protruding downward from the body in a second direction substantially opposite to the first direction, and an end piece shaped to engage the engagement lugs by sliding in a third direction substantially orthogonal to the first direction.

The end piece may further comprise a positioning lug protruding away from the end piece and designed to engage the body for securely positioning the end piece on the bottom portion of the body. Also, the engagement lugs and end piece may be mated by the use of a dovetail configuration, and the end piece may further comprise a clip arm protruding upward alongside the body parallel to its major axis. The dispenser may be formed substantially of plastic.

Important advantages of the present invention include a more tightly-secured aerosol can, a simpler and sturdier dispenser construction, and faster loading of the can into the dispenser.

The foregoing and other objects, features, and advantages of the invention will be apparent from the following more particular description of a preferred embodiment of the invention, as illustrated in the accompanying drawings.

BEST MODE FOR CARRYING OUT THE INVENTION

Figure 1:
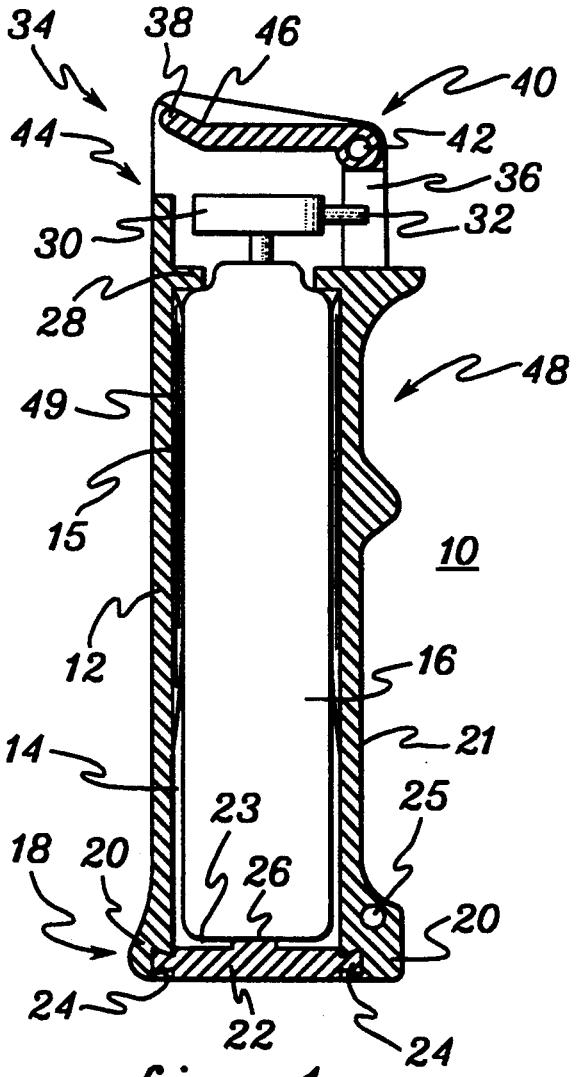
FIG. 1 is a cross-sectional view of an aerosol dispenser according to the present invention.

FIG. 1 is a cross-sectional view of an aerosol dispenser 10 according to the present invention. Dispenser 10 has a body 12 with an interior 14 sized to hold an aerosol can 16. Body 12 has a bottom portion 18 having engagement lugs 20 extending downward therefrom for engaging an end piece 22. When end piece 22 is fastened to body 12 it holds aerosol can 16 within interior 14. Engagement lugs 20 and end piece 22 are joined by a male/female dovetail configuration 24. In other embodiments, however, a manner of joining other than a dovetail may be used. In addition, body 12 has a bottom opening 23 for insertion of aerosol can 16 when end piece 22 is removed, and a hole 25 extending fully therethrough so that, for example, a key chain may be connected to body 12.

It should be appreciated that body 12 has a substantially solid, cylindrical construction. Specifically, the vertical, outside wall 21 of body 12 is substantially solid and without a seam. This is in contrast to a dispenser which opens along a lengthwise seam. The solid construction of the present invention makes dispenser 10 less expensive and sturdier than the prior dispenser with the lengthwise seam.

In one embodiment, dovetail configuration 24 provides a partial friction fit which limits the movement of end piece 22 within engagement lugs 20. However, in other embodiments, there may be substantially no friction fit. Also, end piece 22 has a positioning lug 26 protruding away therefrom and upward into interior 14 for securing end piece 22 into a substantially fixed position. When dispenser 10 is fully assembled, positioning lug 26 may provide an upward force on aerosol can 16 so that can 16 presses against an inner lip 28 of body 12 and is held securely in place.

Can 16 has an actuator cap 30 for actuating discharge, when pressed downward, of the aerosol therewithin out through a nozzle 32. In one embodiment, aerosol can 16 contains a chemical repellent used for repelling humans or animals, as in a self-defense situation. This chemical repellant may be, for example, a tear gas. One such tear gas is sold under the MACE trademark owned by Mark Sport, Inc., of Bennington, Vt.

Body 12 also has a discharge portion 34 having a nozzle opening 36 sized to permit nozzle 32 to protrude therethrough and a moveable top protective flap 38 to prevent accidental discharge of aerosol can 16. Flap 38 is shown in a normally-closed position. A spring 40 is disposed about a hinge 42 for holding flap 38 in the normally-closed position when no external forces are applied to flap 38. In one approach, soon after molding body 12, flap 38 is installed on dispenser 10 by spreading (i.e. flexing) the material forming body 12 in the region of hinge 42 with a spread tool sufficiently so that flap 38 may be inserted in hinge 42 and then allowing the material to substantially return to its original shape. The installation of flap 38 is performed soon after molding so that body 12 is sufficiently pliable.

Discharge portion 34 also has a cut-away portion 44 to permit, for example, a thumb to slip under flap 38 and over actuator cap 30. Cut-away portion 44 has a downwardly-curved lower edge (not fully shown) to facilitate this thumb entry. Also, flap 38 has an angle 46 to further facilitate this thumb entry.

For ease of handling, body 12 may have a hand-grip 48 disposed on its side. Hand-grip 48 is shaped to further facilitate ease of entry of a thumb under flap 38 and certainty of control during pressing of actuator cap 30.

To assist in holding aerosol can 16 securely in place within interior 14, body 12 also has, in the preferred embodiment, four crushable ribs "15" running vertically (i.e. lengthwise) along an inside wall 49 of body 12. The ribs are spaced at about 90 degree intervals on inside wall 49. These ribs partially deform when aerosol can 16 is inserted into body 12 and serve to compensate for manufacturing tolerances of both the outside dimension of can 16 and the inside dimension of body 12 which might result in a loosely-fitted can in the absence of the crushable ribs. With aerosol can 16 installed in body 12, the ribs press against can 16 such that it substantially does not rotate about the major axis of body 12 or slide vertically.

Figure 2:
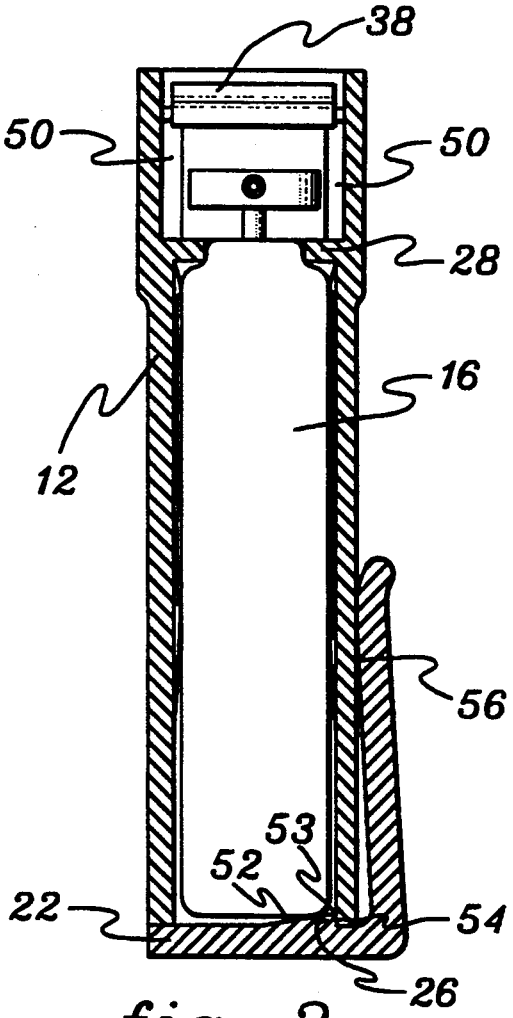
FIG. 2 is a cross-sectional view of the aerosol dispenser of FIG. 1 from a viewpoint orthogonal to that for FIG. 1.

FIG. 2 is a cross-sectional view of aerosol dispenser 10 of FIG. 1 from a viewpoint orthogonal to that for FIG. 1. Flap stops 50 are disposed on opposite walls of body 12 to prevent top protective flap 38 from accidentally being depressed downward onto actuator cap 30 and thereby discharging aerosol from aerosol can 16.

At the bottom of dispenser 10, positioning lug 26 has an inclined surface 52 that leads up to a ledge 53. In the preferred embodiment, positioning lug 26 is a one-way locking lug not intended to be readily removed by a user. End piece 22 fully engages body 12 and locks into place when ledge 53 rests substantially flush against inside lip 54 of body 12. In other embodiments, however, positioning lug 26 could be designed without a ledge, and instead with an inclined surface on both sides of a raised bump. This design would permit removal of end piece 22 from body 12 by the user.

In addition, end piece 22 has a clip arm 56 protruding upward alongside body 12 and parallel to the major axis of body 12. Clip arm advantageously allows dispenser 10 to be carried, for example, on one's waist.

Figure 3:
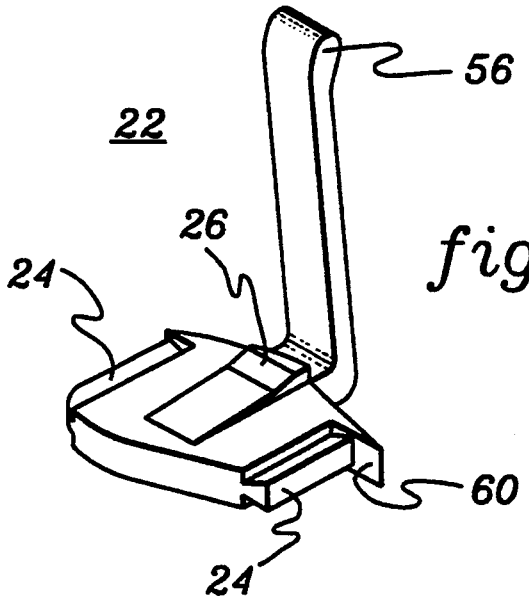
FIG. 3 is an isometric drawing of an end piece for the aerosol dispenser of FIGS. 1 and 2.

FIG. 3 is an isometric view of end piece 22. FIG. 3 illustrates dovetail configuration 24, positioning lug 26, and clip arm 56. A surface 60 of end piece 22 is substantially flush with the outside of body 12 when end piece 22 fastened on the bottom of body 12.

Aerosol dispenser 10 can be formed, for example, of plastic. Plastics that may be used include, for example, polypropylene, polyethylene, or PVC. Further, these plastics may be filled with glass or talc. To manufacture an aerosol dispenser according to the present invention, injection molding or possibly extruding may be used. The preferred manufacturing method is injection molding, and it is preferable that the parts be molded with some flexibility and have good memory.

Referring again to the figures, to use aerosol dispenser 10, aerosol can 16 is axially inserted up through bottom opening 23 with end piece 22 removed. In the embodiment illustrated in FIGS. 1–3, can 16 is inserted in a direction corresponding to the major axis of body 12. However, in other embodiments, this is not required.

After inserting can 16 into body 12, actuator cap 30 is installed on the top of can 16 and end piece 22 is fastened to bottom portion 18 of body 12. In the illustrated embodiment, end piece 22 is fastened by sliding it in a direction substantially orthogonal to the insertion direction of can 16 above. End piece 22 slides within dovetail configuration 24 until surface 60, which is shown in FIG. 3, is substantially flush with body 12 of FIG. 2 and ledge 53 of positioning lug 26 is substantially flush with inside lip 54 of body 12. Engagement lugs 20 have sufficient resilience to permit end piece 22 to slide into place.

Dispenser 10 is discharged by aiming nozzle 32 at a target and then pressing actuator cap 30 with, for example, a thumb, which is slid underneath top protective flap 38. Hand grip 48 is preferably used during discharge by the same hand having the thumb that is depressing cap 30.

In the illustrated embodiment, the user is not intended to replace an exhausted aerosol can. However, if a two-way positioning lug is used, an exhausted aerosol can may be replaced. First, the end piece is removed by sliding in the opposite direction used to fasten it to the body. The old aerosol can is replaced with a new one, and the end piece is again fastened to the body. In some cases it is an advantage that the user cannot replace the aerosol can because he will instead purchase a new unit.

Although the present invention has been described in detail above, it is not intended to be limited to the specific form set forth herein, but, on the contrary, it is intended to cover such alternatives and equivalents as can reasonably be included within the spirit and scope of the invention as defined by the appended claims.

We claim:

1. An aerosol dispenser, comprising:

a body having an interior for holding an aerosol can, a bottom portion and a discharge portion, said aerosol can having a nozzle disposed thereon, said body having an opening proximate to said bottom portion for insertion of said aerosol can in a first direction into said interior and said bottom portion formed with means for slidably receiving an end piece, said discharge portion of said body including a top protective flap connected to said body for preventing accidental discharge of said aerosol can and an opening, disposed below said flap on said body, sized for said nozzle so that said nozzle is directed substantially orthogonal to said first direction; and an end piece configured for holding said aerosol can within said interior of said body, said end piece formed for installation on said body by engaging the receiving means and sliding in a second direction substantially orthogonal to said first direction, said end piece including a positioning lug protruding away from said end piece and designed to engage said body for securely positioning said end piece on said bottom portion of said body, wherein said positioning lug is a one-way locking lug with an inclined surface with a height that increases moving in a direction away from the center of said end piece.

2. The dispenser of claim 1 wherein said first direction is substantially parallel with the major axis of said body.

3. The dispenser of claim 1 wherein said end piece uses a dovetail configuration for engaging said body.

4. The dispenser of claim 1 wherein said end piece further comprises a clip arm.

5. The dispenser of claim 1 wherein said receiving means comprises an engagement means, disposed proximate to said bottom portion and protruding downward from said body, for accepting said end piece.

6. The dispenser of claim 1 wherein said insertion of said aerosol can comprises axial insertion thereof.

7. The dispenser of claim 1 wherein said dispenser is substantially cylindrical-shaped.

8. The dispenser of claim 1 wherein said aerosol can contains a chemical repellant.

9. An aerosol dispenser for discharging a chemical repellant contained within an aerosol can, comprising:

a substantially cylindrical body having a major axis, an interior sized to accept said aerosol can, a discharge portion, and a bottom portion disposed distal from said discharge portion, said body having an opening proximate to said bottom portion for axial insertion of said aerosol can in a first direction into said interior;

a pair of engagement lugs, disposed on said bottom portion of said body and protruding downward from said body in a second direction substantially opposite to said first direction; and an end piece shaped to engage said engagement lugs by sliding in a third direction substantially orthogonal to said first and second directions.

10. The dispenser of claim 9 wherein:

said end piece further comprises a positioning lug protruding away from said end piece and designed to engage said body for securely positioning said end piece on said bottom portion of said body.

11. The dispenser of claim 9 wherein:

said engagement lugs each have a female dovetail; and said end piece has a pair of male dovetails oppositely disposed for engaging said female dovetails of said engagement lugs.

12. The dispenser of claim 9, 10 or 11 wherein said end piece further comprises a clip arm protruding upward alongside said body substantially parallel to said major axis.

13. The dispenser of claim 12 further comprising an aerosol can.

14. A method for encapsulating an aerosol canister into an aerosol dispenser, comprising the steps:

inserting an aerosol canister axially in a first direction tin an interior of an aerosol dispenser, said aerosol dispenser having a substantially cylindrical body, a discharge portion, and a bottom portion disposed distal from said discharge portion;

aligning a spray nozzle of said aerosol canister so that said spray nozzle fits within a spray nozzle opening of said discharge portion; and sliding an end piece into a pair of engagement lugs of said bottom portion of said aerosol dispenser in a second direction substantially orthogonal to said first direction.

* * * * *

UNITED STATES PATENT AND TRADEMARK OFFICE

CERTIFICATE OF CORRECTION

PATENT NO. : 5,348,193

DATED : September 20, 1994

INVENTOR(S) : James V. Bruckner and Tony A. Bruckner

It is certified that error appears in the above-indentified patent and that said Letters Patent is hereby corrected as shown below:

In the Claims:

Column 6, line 28, change "tin" to —into—.

Signed and Sealed this

Twentieth Day of December, 1994

*Attest:*

Bruce Lehman

BRUCE LEHMAN

*Attesting Officer*

*Commissioner of Patents and Trademarks*